US010265920B2

(12) United States Patent
Kistner

(10) Patent No.: US 10,265,920 B2
(45) Date of Patent: Apr. 23, 2019

(54) HIDDEN DISPLAY CASE WITH OFFSET CENTER SEAM GLUE JOINT

(71) Applicant: INTERNATIONAL PAPER COMPANY, Memphis, TN (US)

(72) Inventor: Matthew Wayne Kistner, Hudson, WI (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 73 days.

(21) Appl. No.: 15/386,798

(22) Filed: Dec. 21, 2016

(65) Prior Publication Data

US 2018/0168368 A1 Jun. 21, 2018

(51) Int. Cl.

| | |
|---|---|
| ***B65D 5/00*** | (2006.01) |
| ***B31D 5/00*** | (2017.01) |
| ***B65D 5/16*** | (2006.01) |
| ***B65D 5/52*** | (2006.01) |
| ***B65D 5/54*** | (2006.01) |

(52) U.S. Cl.

CPC ..... *B31D 5/00* (2013.01); *B65D 5/16* (2013.01); *B65D 5/52* (2013.01); *B65D 5/542* (2013.01)

(58) Field of Classification Search

CPC ..... B65D 5/542; B65D 5/16; B65D 5/4204; B65D 5/00

USPC .. 229/164, 240, 122, 122.24, 122.32, 162.7; 206/736, 738

See application file for complete search history.

(56) References Cited

U.S. PATENT DOCUMENTS

| | | | | |
|---|---|---|---|---|
| 1,902,566 A | | 3/1933 | Marsh | |
| 3,554,402 A | * | 1/1971 | Lock | B65D 5/18 206/193 |
| 3,568,911 A | * | 3/1971 | Bebout | B65D 5/722 206/738 |
| 3,664,494 A | * | 5/1972 | Mergens | B65D 5/2038 206/45.2 |
| 3,869,077 A | * | 3/1975 | Tuura | B65D 5/0236 229/117.16 |
| 3,917,158 A | * | 11/1975 | Dorofachuk | B65D 5/0227 229/164 |
| 3,944,128 A | * | 3/1976 | Hogan | B65D 5/722 229/221 |
| 4,401,255 A | | 8/1983 | Conroy | |
| 5,752,597 A | | 5/1998 | Brangle, Jr. | |
| 5,842,576 A | | 12/1998 | Snow | |
| 6,158,579 A | | 12/2000 | Rosenbaum | |

(Continued)

*Primary Examiner* — Brian D Nash

(74) *Attorney, Agent, or Firm* — Thomas W. Ryan; Michael D. Folkerts

(57) ABSTRACT

A folded blank for forming a display case and a display case formed from the folded blank. The folded blank comprises a one-piece blank including a first panel, a second panel, a third panel and a fourth panel connected in series at respective first, second and third vertical fold lines. The first panel is folded about the first vertical fold line and is engaged on a first portion of the second panel at a first manufacturer's joint strip. The fourth panel is folded about the third fold line and is engaged on the first panel at a second manufacturer's joint strip. The first portion forms a tear-away section defined by at least one separation line on the second panel. The first manufacturer's joint strip retains the tear-away section in engagement with the first panel during erection of the folded blank to form the display case having a display window.

13 Claims, 5 Drawing Sheets

(56) References Cited

U.S. PATENT DOCUMENTS

| | | | | |
|---|---|---|---|---|
| 6,371,365 | B1 * | 4/2002 | Doucette | B65D 5/5445 229/120.011 |
| 6,402,021 | B1 | 6/2002 | Heathcock | |
| 6,499,655 | B1 * | 12/2002 | Moen | B65D 5/322 229/120.24 |
| 6,874,679 | B2 * | 4/2005 | Tibbles | B65D 5/001 229/120.11 |
| 7,080,736 | B2 * | 7/2006 | Jackson | B65D 5/16 206/738 |
| 7,472,819 | B1 * | 1/2009 | Wachter | B65D 5/0281 229/164 |
| 7,607,566 | B2 * | 10/2009 | Philips | B65D 5/001 229/157 |
| 8,328,079 | B2 | 12/2012 | Kohler | |
| 8,800,854 | B2 * | 8/2014 | Chapman | B65D 5/029 229/122.32 |
| 9,061,791 | B2 * | 6/2015 | Cameron | B65D 5/5405 |
| 9,938,040 | B2 | 4/2018 | Buscema | |
| 9,994,356 | B2 * | 6/2018 | Couture | B31B 50/48 |
| 2001/0000203 | A1 | 4/2001 | Yuhas | |
| 2005/0155905 | A1 | 7/2005 | Monk | |
| 2015/0060538 | A1 | 3/2015 | Laughman et al. | |
| 2018/0168367 | A1 | 6/2018 | Kistner | |

* cited by examiner

HIDDEN DISPLAY CASE WITH OFFSET CENTER SEAM GLUE JOINT

RELATED APPLICATIONS

This application is related to U.S. patent application Ser. No. 15/386,644, entitled "HIDDEN DISPLAY CASE," filed Dec. 21, 2016, which is hereby incorporated by reference in its entirety.

FIELD OF THE INVENTION

The present invention relates to improvements in containers and, more particularly, to a container configured as a display case having a display window formed at one side of the display case.

BACKGROUND OF THE INVENTION

A half slotted container (HSC) is a common construction for forming corrugated cardboard containers. This type of container is typically formed from a blank that includes front, back and side wall panels connected in series at vertical edges along fold lines, and lower flaps may extend from lower edges of the panels for folding inwardly to form a container bottom. The blank can be folded about the vertical edges to position an end of the blank defining an edge of a side panel in association with an opposing end of the blank defining an edge of one of the front or back panels to form a joint that is typically adhered together by a manufacturer to form a rectangular tube. The blank formed with the manufacturer's joint can be collapsed and provided to an end user where the blank can be reconfigured to a rectangular tube and the flaps folded perpendicular to the panels to form a bottom surface for the container.

SUMMARY OF THE INVENTION

In accordance with an aspect of the invention, a folded blank is provided for forming a display case. The folded blank comprises a one-piece blank including a first panel, a second panel, a third panel and a fourth panel connected in series at respective first, second and third vertical fold lines. The first panel is folded about the first vertical fold line and has a first manufacturer's joint strip engaged on a first portion of the second panel. The fourth panel is folded about the third fold line and has a second manufacturer's joint strip engaged on the first panel. A tear-away section is defined by at least one separation line on the second panel and defines the first portion having the first manufacturer's joint strip. The first manufacturer's joint strip retains the tear-away section in engagement with the first panel during formation of an erected case in which the first and third panels are pivoted to a position perpendicular to at least one portion of the fourth panel.

The fourth panel may include a main body and a secondary section connected to the main body at a fourth vertical fold line, and the main body may define the at least one portion of the fourth panel.

The secondary section of the fourth panel and the first panel may define a seamed panel having a longitudinal dimension extending from the first fold line to the fourth fold line that may be generally equal to a longitudinal dimension of the third panel extending from the second fold line to the third fold line.

The seamed panel, a second portion of the second panel, the third panel and the main body of the fourth panel may define a first side wall, a front wall, a second side wall and a back wall, respectively, of the erected case.

The tear-away section may separate from the second portion of the second panel during formation of the erected case.

The main body of the fourth panel may have a longitudinal dimension extending from the third fold line to the fourth fold line that is generally equal to a longitudinal dimension of the second panel extending from the first fold line to the second fold line.

A longitudinal dimension of the first panel from a longitudinal edge of the blank to the first fold line may be generally equal to or less than the longitudinal dimension of the second panel.

The at least one separation line may be a horizontally extending separation line defining a lower edge of the tear-away section, and the blank may include a vertical separation line defining a first vertical edge of the tear-away section aligned with the second fold line.

A second vertical edge of the tear-away section spaced from the vertical separation line may be pivotally connected to the first panel at the first fold line.

The first manufacturer's joint strip may be located adjacent to the vertical separation line, and the first manufacturer's joint strip may extend from an upper edge of the first panel to a vertical location at or above the location of the at least one separation line.

The first and second manufacturer's joint strips may be generally aligned with one another.

A lower flap may be attached to a lower edge of each of the panels at a respective horizontal fold line, wherein lower edges of the flaps may define a lower lateral edge of the blank.

The second manufacturer's joint strip may extend from an upper edge of the fourth panel to the lower lateral edge of the blank.

In accordance with another aspect of the invention, a display case is provided formed from a blank comprising a first panel, a second panel, a third panel and a fourth panel connected in series at respective first, second and third vertical fold lines, the second panel including a tear-away section defining a first portion of the second panel separated from a second portion of the second panel by a separation line, and the fourth panel including a main body and a secondary section connected to the main body at a fourth vertical fold line. The display case comprises a front wall defined by the second portion of the second panel, a back wall defined by the fourth panel main body parallel to the front wall, a first side wall defined by the first panel and the secondary section, and a second side wall defined by the third panel, wherein the first and second side walls connect the front and back walls. A first manufacturer's joint strip is engaged between the first panel and the first portion of the second panel to attach the first portion of the second panel to the first panel. A second manufacturer's joint strip is engaged between the first panel and the secondary section of the fourth panel at a location along the first side wall intermediate the front and back walls.

A dimension of the front and back walls extending from the first side wall to the second side wall may be less than a dimension of the first and second side walls extending from the front wall to the back wall.

A dimension of the first panel extending from a longitudinal edge of the blank to the first fold line may be less than a dimension of the third panel extending from the second fold line to the third fold line.

In accordance with a further aspect of the invention, a method of forming a display case is provided. The method forms the display case from a one-piece blank comprising a first panel, a second panel, a third panel and a fourth panel connected in series at respective first, second and third vertical fold lines, the second panel including a tear-away section defining a first portion of the second panel separated from a second portion of the second panel by a separation line, and the fourth panel including a main body and a secondary section connected to the main body at a fourth vertical fold line. The method comprises applying a first manufacturer's joint strip to the first panel; folding the first panel about the first fold line to engage the first panel on the tear-away section of the second panel; applying a second manufacturer's joint strip to the fourth panel; folding the fourth panel about the third fold line to engage the fourth panel on the first panel; and pivoting the first and third panels to a position perpendicular to the main body of the fourth panel, wherein the tear-away section moves with the first panel to separate from the second portion of the second panel along the at least one separation line and forms an erected case with a display window.

Movement of the tear-away section with the first panel may include separating the tear-away section from the third panel along a vertical separation line defining a first vertical edge of the tear-away section aligned with the second fold line.

The pivoting movement to form the erected case may include maintaining the secondary section coplanar with the first panel and pivoting the secondary section to a perpendicular position relative to the main body.

The blank may comprise opposing first and second longitudinal edges located at edges of the first and fourth panels respectively, and the first and second manufacturer joint strips may be applied adjacent to the first and second longitudinal edges, respectively.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction comprising a half slotted container (HSC) construction that provides a display case having a display window formed by a tear-away section. The described display case can be formed from a blank processed either with equipment designed for this purpose or by hand. For example, the blank may be processed through flexo-folder-gluer machinery to produce a glued, folded blank that can be opened using currently available case erector machinery or can be produced through manually executed steps, or through a combination of machine implemented and manual steps.

Figure 1:
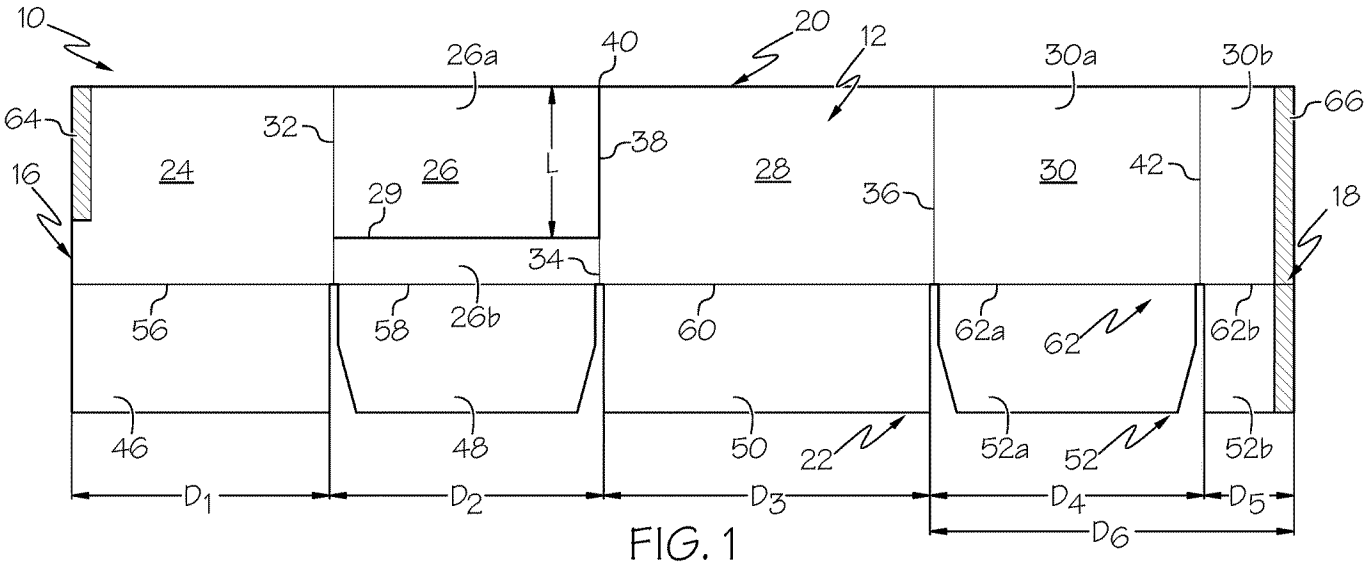
FIG. 1 is a plan view of a blank for forming a display case.
Figure 2:
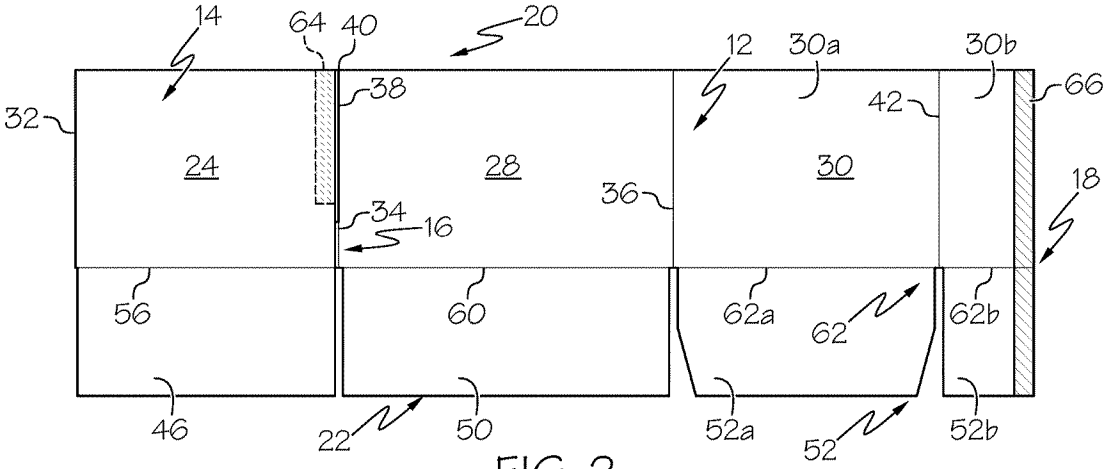
FIG. 2 is a plan view illustrating a first fold of the blank of FIG. 1.

Referring to FIG. 1, a die cut blank 10 is shown for illustrating one or more aspects of the display case described herein. In a use of the blank to form a one-piece display case 8, see FIG. 7, the blank 10 may be formed of a corrugated cardboard material and may be die cut to the shape shown herein, although other materials and variations of the illustrated shape may be provided within the scope of the display case described and claimed herein. The blank 10 illustrated in FIG. 1 is a planar piece of material in which an inner side 12 is shown facing out of the page and an outer side 14, see FIG. 2, is facing an opposite direction from the inner side 12.

As seen in FIG. 1, the blank 10 extends in a longitudinal direction between first and second longitudinal edges, generally designated 16 and 18, respectively, The blank 10 further extends in a lateral direction between first and second lateral edges, generally designated 20 and 22, respectively, defining upper and lower lateral edges of the blank 10. The blank 10 comprises a first panel 24, a second panel 26, a third panel 28 and a fourth panel 30 connected in series. The first panel 24 is connected to the second panel 26 at a first vertical fold line 32, the second panel 26 is connected to the third panel 28 at a second vertical fold line 34, and the third panel 28 is connected to the fourth panel 30 at a third vertical fold line 36.

The second panel 26 comprises a separation line 29 extending from the first vertical edge 38 to the first vertical fold line 32 and defines a first portion 26*a* or tear-away section above the separation line 29, and defining a second portion 26*b* or front lip below the separation line 29. In the illustrated embodiment, the separation line comprises a horizontal straight line. However, the separation line 29 could be generally horizontal yet have other line shapes, such as an arc or have an oscillating shape, e.g., a sine wave, triangular wave, square wave or sawtooth wave. It is also contemplated that the separation line 29 could be non-horizontal such that it extends at an angle to horizontal. The separation line 29 could also include plural lines or line segments connected in series, e.g., in different angled orientations or with different or varying arcs, to form a continuous extending line between the first vertical edge 38 and the first vertical fold line 32. The first portion 26*a* extends in the longitudinal direction between a first vertical edge 38 of the tear-away section and a second vertical edge that coincides with the first vertical fold line 32. The first vertical edge 38 is defined at a vertical separation line 40 aligned with the second vertical fold line 34. The vertical separation line 40 extends a distance L from the first lateral edge 20, i.e., the upper edge of the blank 10, to the separation line 29. The separation lines 29, 40 may be defined, for example, by a perforated line, or a cut line that extends completely through the material, and may comprise a partial cut though at least one layer of the corrugated material or a cut line interrupted by short sections of bridging (uncut) material. As will be further understood from the description below, the separation lines 29, 40 form structurally weakened lines on the second panel 26 that can permit separation of the first portion 26*a* from both the second portion 26*b* and the third panel 28 during formation of the display case 8. In embodiments of the invention, the blank 10 is formed with at least a limited attachment of the first portion 26*a* to the second portion 26*b* and/or to the third panel 28 to maintain the first portion 26*a* generally planar with both the second portion 26*a* and the third panel 28 in order to facilitate processing of the blank 10 prior to formation of the erected display case 8.

The fourth panel 30 comprises a main body 30*a* and a secondary section 30*b*. The main body 30*a* of the fourth panel 30 is connected to the third panel 28 at the third vertical fold line 36, and a secondary section 30*b* of the fourth panel 30 is connected to the main body 30*a* at a fourth vertical fold line 42.

The first panel 24 has a longitudinal dimension $D_1$, extending from the first longitudinal edge 16 to the first vertical fold line 32, that is generally equal to or less than a longitudinal dimension $D_2$ of the second panel 26, extending from the first vertical fold line 32 to the second vertical fold line 34. The longitudinal dimension $D_1$ of the first panel 24 is also less than or equal to a longitudinal dimension $D_3$ of the third panel 28, extending from the second vertical fold line 34 to the third vertical fold line 36. The main body 30*a* of the fourth panel 30 has a longitudinal dimension $D_4$, extending from the third vertical fold line 36 to the fourth vertical fold line 42, that is generally equal to the longitudinal dimension $D_2$ of the second panel 26. The secondary section 30*b* of the fourth panel 30 has a longitudinal dimension $D_5$, extending from the fourth vertical fold line 42 to the second longitudinal edge 18, that is selected to overlap the first panel 24 when the fourth panel 30 is pivoted about the third vertical fold line 36, as is described further below. In particular, the fourth panel 30 has a longitudinal dimension $D_6$, see FIG. 3, that is equal to the longitudinal dimension $D_4$ of the main body 30*a* plus the longitudinal dimension $D_5$ of the secondary section 30*b*, wherein $D_6$ is greater than the longitudinal dimension $D_3$ of the third panel 28.

The blank 10 further includes a plurality of lower flaps 46, 48, 50, 52 connected to the first panel 24, second panel 26, third panel 28 and fourth panel 30 along respective horizontal fold lines 56, 58, 60, 62. The lower flap 52 associated with the fourth panel 30 comprises a first flap portion 52*a* associated with the main body 30*a* and a second flap portion 52*b* separate from the first flap portion 52*a* and associated with the secondary section 30*b*. The lower flaps 46, 48, 50, 52 can be folded to form a display case bottom surface 63, see FIG. 7, as described further below.

Figure 3:
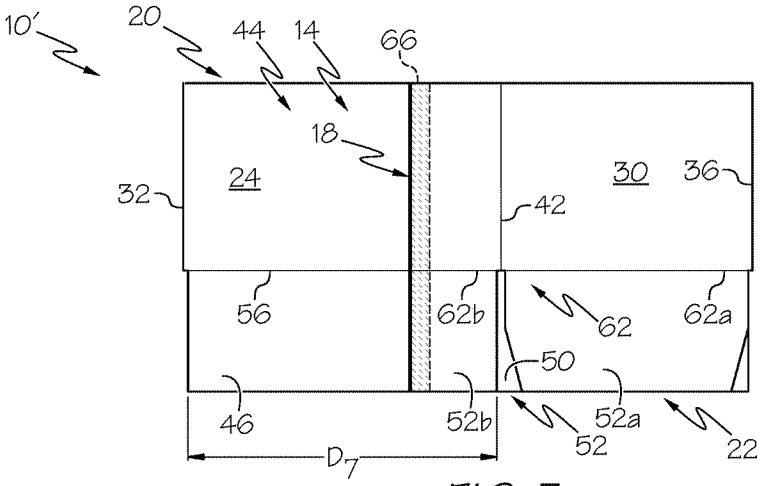
FIG. 3 is a plan view illustrating a second fold of the blank of FIG. 1 to form a glued, folded blank for formation of a display case.
Figure 4:
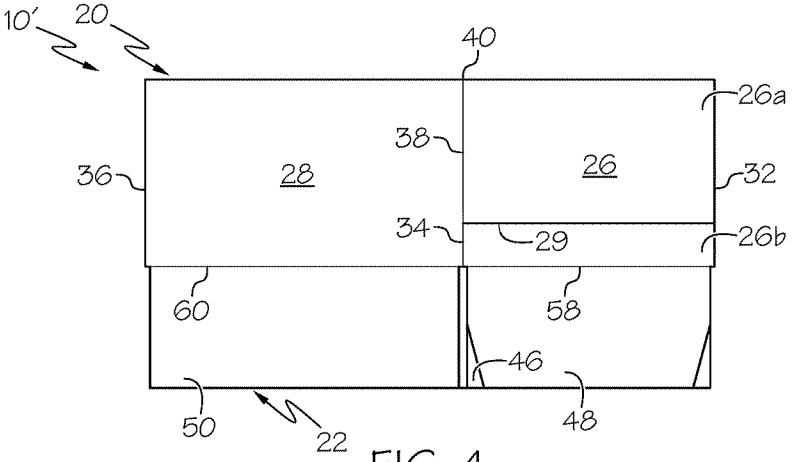
FIG. 4 is a plan view of an opposite side of the glued, folded blank of FIG. 3.

Referring to FIGS. 2-4, an initial series of folding steps is described for forming a glued, folded blank that can subsequently be used in forming the erected display case 8. Although the preferred embodiments presented herein describe applying an "adhesive strip" forming a joint to connect two panels, it should be understood that such a joint or connection between panels can be equivalently formed through other attachment mechanisms connecting the panels together, and may be alternatively referred to as a "manufacturer's joint strip" encompassing, without limitation, gluing, taping, or stitching.

As illustrated in FIG. 1, a first adhesive strip 64, e.g., glue, is applied to the inner side 12 of the blank 10 adjacent to the first longitudinal edge 16. As illustrated in FIG. 2, the first panel 24 is folded about the first vertical fold line 32 to overlap the second panel 26 and adhesively, i.e., fixedly, engage the first panel 24 on the first portion 26*a*. More specifically, as noted above, the longitudinal dimension $D_1$ of the first panel 24 is equal to or less than the longitudinal dimension $D_2$ of the second panel 26 such that the first adhesive 64 may engage the first portion 26*a* adjacent to the vertical separation line 40. It should be noted that the adhesive strip 64 is applied to the first panel 24 along a vertical length no greater than and preferably less than the length L of the vertical separation line 40, as measured from the first lateral edge 20 defining the upper edge of the first panel 24.

As seen in FIG. 2, a second adhesive strip 66, e.g., glue, is applied to the inner side 12 of the fourth panel 30 adjacent to the second longitudinal edge 18. As illustrated in FIG. 3, the fourth panel 30 is folded about the third vertical fold line 36 to overlap the third panel 28 such that the fourth panel 30 adhesively, i.e., fixedly, engages the first panel 24. More specifically, as described above, the longitudinal dimension $D_6$ of the fourth panel 30 is such that the second longitudinal edge 18 overlaps past the first longitudinal edge 16 defined on the first panel 24, and the second adhesive strip 66 is adhesively attached to the outer side 14 of the first panel 24. The vertical length of the second adhesive strip 66 may be substantially equal to the vertical length of the blank 10 to form a continuous joint extending from the upper lateral edge 20 of the fourth panel 30 to the lower lateral edge of the second flap portion 52*b*, as defined by the lower lateral edge 22 of the blank 10. Also, the first and second adhesive strips 64, 66 are located on opposing sides 12, 14 of the first panel 24 wherein the second adhesive strip 66 may be generally aligned in the longitudinal direction, i.e., extending left to right in FIG. 1, with the first adhesive strip 64 so that the second adhesive strip 66 is generally aligned with the first adhesive strip 64 as both extend vertically.

The attachment of the fourth panel 30 to the first panel 24 forms a seamed panel 44 having an offset center seam glue joint defined by the adhesive strip 66 at an intermediate location between the first vertical fold line 32 and the fourth vertical fold line 42. The seamed panel 44 is defined by the first panel 24 and the secondary section 30*b*, having a longitudinal dimension $D_7$ between the first vertical fold line 32 and the fourth vertical fold line 42, wherein the first panel 24 and the secondary section 30*b* remain generally coplanar with each other during formation of the erected display case 8. The longitudinal dimension $D_7$ of the seamed panel 44 is generally equal to the longitudinal dimension $D_3$ of the third panel 28.

FIGS. 3 and 4 illustrate opposing outer sides of a folded blank 10' having a generally flat configuration such as may be shipped to an end user for formation of the erected display case 8.

Figure 5:
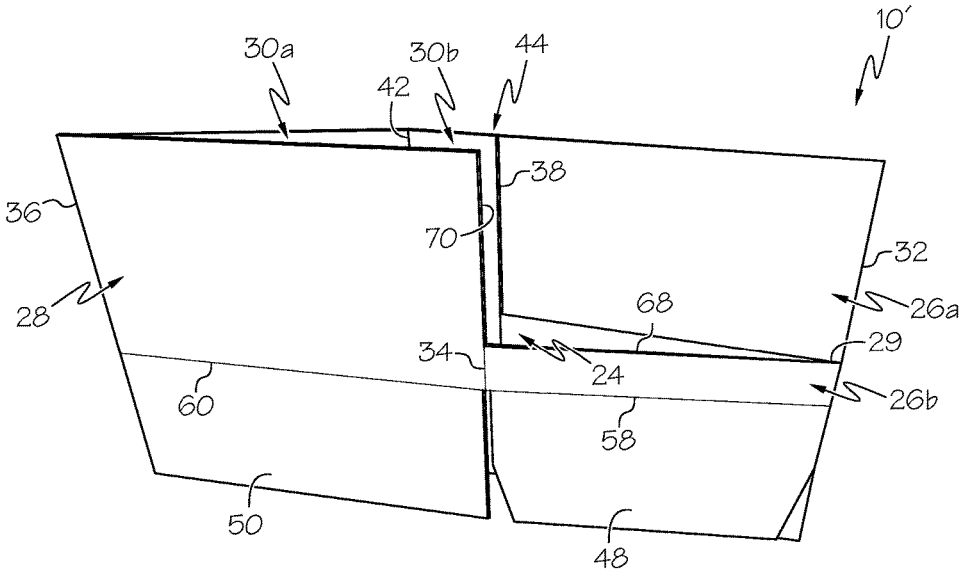
FIG. 5 is a perspective view illustrating an initial step of opening the glued, folded blank to form an erected display case.
Figure 6:
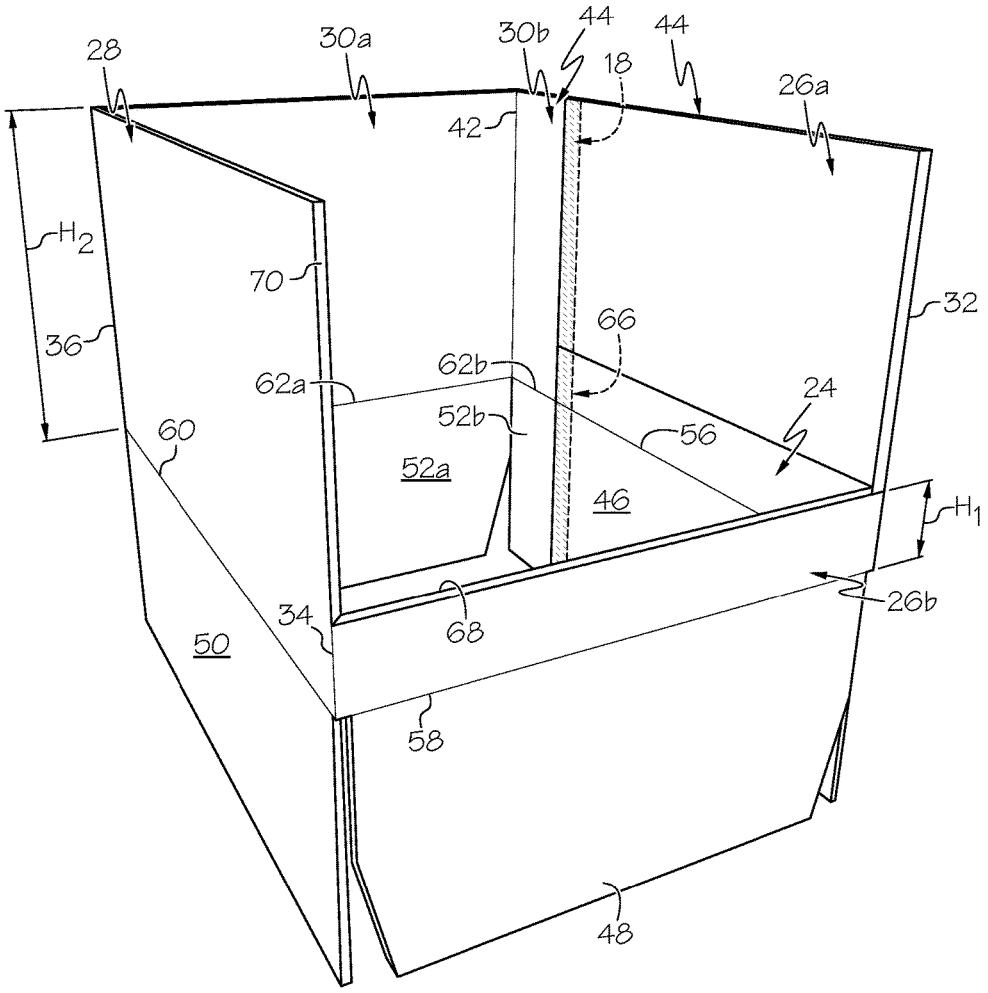
FIG. 6 is a perspective view of the glued, folded blank in a fully open position.

FIG. 5 illustrates an initial step in erecting the folded blank 10' to form the display case 8. The folded blank 10' is erected by separating the second panel second portion 26*b* and third panel 28 from the seamed panel 44 (including the second panel first portion 26*a*) and the fourth panel main body 30*a*, and pivoting the third panel 28 and the seamed panel 44 about the third vertical fold line 36 and the fourth vertical fold line 42, respectively, to position the third panel 28 and seamed panel 44 perpendicular to the fourth panel main body 30*a*, as seen in FIG. 6. As described above, the first portion 26*a* of the second panel 26 is adhered to the first panel 24. Hence, the described movement to erect the folded blank 10' results in separation of the tear-away section of the second panel 26, as defined by the first portion 26*a*, separating from the second portion 26*b* along the separation line 29, and at the same time the first vertical edge 38 of the tear-away section, i.e., first portion 26*a*, separates from the third panel 28 along the vertical separation line 40. In the configuration of the fully erected blank illustrated in FIG. 6, the second panel second portion 26*b* defines a front wall, the fourth panel main body 30*a* defines a back wall parallel to the front wall, the seamed panel 44 defines a first side wall, and the third panel 28 defines a second side wall.

Figure 7:
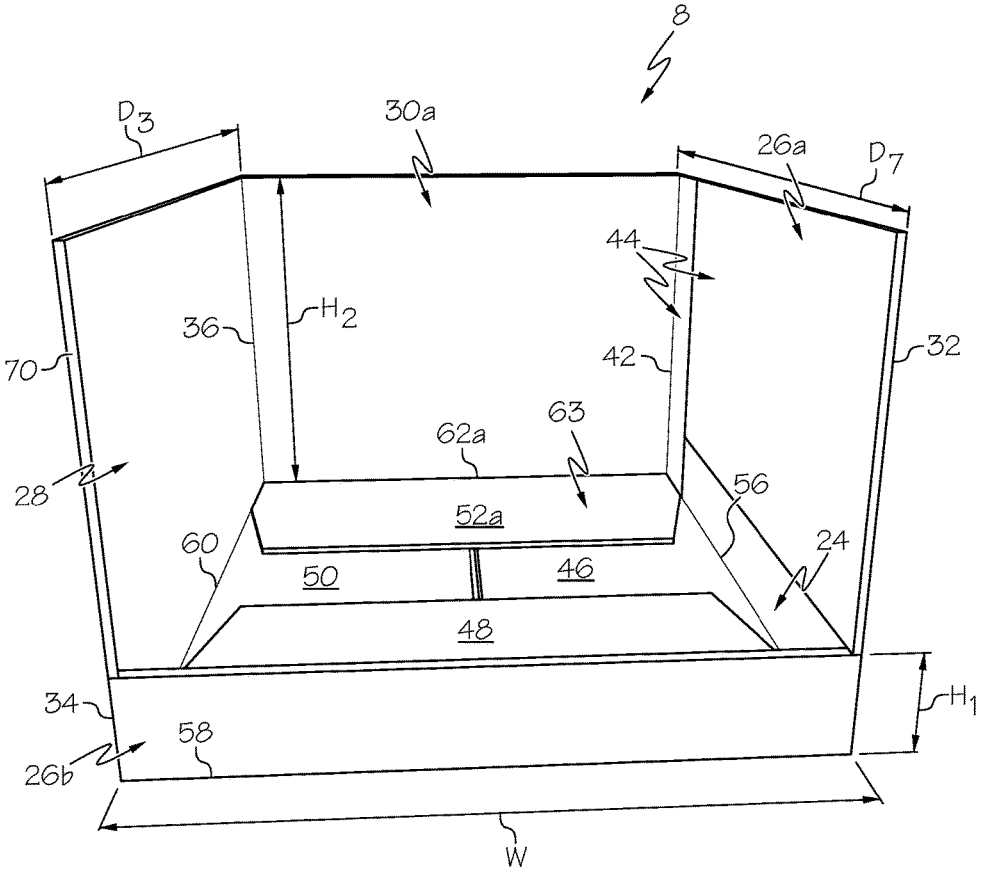
FIG. 7 is a perspective similar to FIG. 6 with the lower flaps folded to complete the display case formed from the blank of FIG. 1.

The described separation of the tear-away section defined by the first portion 26*a* along the separation lines 29, 40 creates a display case window at the remaining second portion 26*b* of the second panel 26. In particular, as seen in FIGS. 6 and 7, the second portion 26*b* defines a vertical front display case lip, extending horizontally from the first vertical fold line 32 to the second vertical fold line 34, including an upper edge 68 forming a lower boundary of the display case window. The upper edge 68 of the front display case lip may be formed with different line shapes than the horizontal straight line illustrated herein. Specifically, the final shape of the upper edge 68 can be determined by the shape selected for the separation line 29 which, as described above with regard to the configuration of the separation line 29, can be defined by various line shapes and line orientations extending between the first vertical fold line 32 and the second vertical fold line 34.

Vertical side edges of the display case window are defined by the second vertical edge of the tear-away section defined at the first vertical fold line 32, and at a forward edge 70 of the third panel 28 defined at the location of the vertical separation line 40. In an embodiment of the display case 8, the front display case lip formed by the second portion 26*b* may have a height $H_1$ while the fourth panel main body 30*a* may have a height $H_2$ that is greater than the height $H_1$ and can be selected independently of the height $H_1$, such as may be based on the requirements of the end user.

It may be noted that lower flap 46 and second flap portion 52*b* form a seamed lower flap associated with the seamed panel 44, and the first flap portion 52*a* comprises a lower flap associated with the fourth panel main body portion 30*a*. As a final step in the formation of the display case 8, the lower flaps 48, 50, 52*a*, 46/52*b* are folded inwardly to form the bottom case surface 63, see FIG. 7. As depicted in the illustrated embodiment, the opposing lower flaps 48 and 52*a* can be initially folded in, and the remaining opposing lower flaps 50, 46/52*b* can be folded over the lower flaps 48, 52*a* and affixed in place to form the bottom case surface 63 via adhesive, tape, staples or the like. Alternatively, the opposing lower flaps 50, 46/52*b* can be initially folded in, and the remaining opposing lower flaps 48, 52*a* can be folded in over the lower flaps 50, 46/52*b*.

As illustrated in FIG. 7, the erected display case 8 includes the tear-away section, formed by the first portion 26*a*, as a part of the final display case 8. It may be noted that the width dimension W across the display case window for the present embodiment is less than the depth dimension $D_3$ and $D_7$ along each of the seamed panel 44 and the third panel 28, from the front lip 26*b* to the fourth panel main body 30*a*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A folded blank for forming a display case, the folded blank comprising:

a one-piece blank including a first panel, a second panel, a third panel and a fourth panel connected in series at respective first, second and third vertical fold lines;

the first panel folded about the first vertical fold line and having a first manufacturer's joint strip engaged on a first portion of the second panel;

the fourth panel folded about the third fold line and having a second manufacturer's joint strip engaged on the first panel, the fourth panel includes a main body and a secondary section connected to the main body at a fourth vertical fold line, the main body defining the at least one portion of the fourth panel;

a tear-away section defined by at least one separation line on the second panel and defining the first portion having the first manufacturer's joint strip;

the first manufacturer's joint strip retaining the tear-away section in engagement with the first panel during formation of an erected case in which the first and third panels are pivoted to a position perpendicular to at least one portion of the fourth panel and wherein the secondary section of the fourth panel and the first panel define a seamed panel having a longitudinal dimension extending from the first fold line to the fourth fold line that is generally equal to a longitudinal dimension of the third panel extending from the second told lire to the third fold line.

2. The folded blank as set forth in claim 1, wherein the seamed panel, a second portion of the second panel, the third panel and the main body of the fourth panel define a first side wall, a front wall, a second side wall and a back wall, respectively, of the erected case.

3. The folded blank as set forth in claim 2, wherein the tear-away section separates from the second portion of the second panel during formation of the erected case.

4. The folded blank as set forth in claim 1, wherein the main body of the fourth panel has a longitudinal dimension extending from the third fold line to the fourth fold line that is generally equal to a longitudinal dimension of the second panel extending from the first fold line to the second fold line.

5. The folded blank as set forth in claim 4, wherein a longitudinal dimension of the first panel from a longitudinal edge of the blank to the first fold line is generally equal to or less than the longitudinal dimension of the second panel.

6. The folded blank as set forth in claim 1, wherein the at least one separation line is a horizontally extending separation line defining a lower edge of the tear-away section, and including a vertical separation line defining a first vertical edge of the tear-away section aligned with the second fold line.

7. The folded blank as set forth in claim 6, wherein a second vertical edge of the tear-away section spaced from the vertical separation line is pivotally connected to the first panel at the first fold line.

8. The folded blank as set forth in claim 6, wherein the first manufacturer's joint strip is located adjacent to the vertical separation line, and the first manufacturer's joint strip extends from an upper edge of the first panel to a vertical location at or above the location of the at least one separation line.

9. The folded blank as set forth in claim 1, wherein the first and second manufacturer's joint strips are generally aligned with one another.

10. The folded blank as set forth in claim 1, including a lower flap attached to a lower edge of each of the panels at a respective horizontal fold line, wherein lower edges of the flaps define a lower lateral edge of the blank.

11. The folded blank as set forth in claim 10, wherein the second manufacturer's joint strip extends from an upper edge of the fourth panel to the lower lateral edge of the blank.

12. A display case formed from a blank comprising a first panel, a second panel, a third panel and a fourth panel connected in series at respective first, second and third vertical fold lines, the second panel including a tear-away section defining a first portion of the second panel separated from a second portion of the second panel by a separation line, and the fourth panel including a main body and a secondary section connected to the main body at a fourth vertical fold line, the display case comprising:

a front wall defined by the second portion of the second panel;

a back wall defined by the fourth panel main body parallel to the front wall;

a first side wall defined by the first panel and the secondary section;

a second side wall defined by the third panel, wherein the first and second side walls connect the front and back walls;

a first manufacturer's joint strip engaged between the first panel and the first portion of the second panel to attach the first portion of the second panel to the first panel; and a second manufacturer's joint strip engaged between the first panel and the secondary section of the fourth panel at a location along the first side wall intermediate the front and back walls, wherein a dimension of the front and back walls extending from the first side wall to the second side wall is less than a dimension of the first and second side wall extending from the front wall to the back wall.

13. The display case as set forth in claim 12, wherein a dimension of the first panel extending from a longitudinal edge of the blank to the first fold line is less than a dimension of the third panel extending from the second fold line to the third fold line.

* * * * *